United States Patent [19]

Knopf

[11] Patent Number: 4,514,140

[45] Date of Patent: Apr. 30, 1985

[54] AXIAL FAN

[75] Inventor: Franz Knopf, Graz, Austria

[73] Assignee: Hans List, Graz, Austria

[21] Appl. No.: 550,178

[22] Filed: Nov. 9, 1983

Related U.S. Application Data

[63] Continuation of Ser. No. 288,809, Jul. 31, 1981, abandoned.

[30] Foreign Application Priority Data

Aug. 5, 1980 [AT] Austria ..... 4047/80

[51] Int. Cl.[3] ..... F04D 29/66

[52] U.S. Cl. ..... 415/119; 415/207; 415/213 C; 123/41.49; 181/204

[58] Field of Search ..... 415/119, 182, 207, 219 R, 415/213 C; 416/247; 123/41.11, 41.49, 41.65, 41.66, 198 E; 181/204

[56] References Cited

U.S. PATENT DOCUMENTS 2,668,523 2/1954 Lamb ..... 123/41.49

4,173,995 11/1979 Beck ..... 415/210 X 4,184,471 1/1980 Kirchweger et al. ..... 181/204 X

FOREIGN PATENT DOCUMENTS 373146 5/1932 United Kingdom ..... 416/247

*Primary Examiner*—Robert E. Garrett

*Assistant Examiner*—Timothy E. Nauman

*Attorney, Agent, or Firm*—Watson, Cole, Grindle & Watson

[57] ABSTRACT

An axial fan, preferably for the cooling systems of water-cooled internal combustion engines, comprises an impeller and an air duct housing provided with a fan guard which is separated by an annular gap from the tips of the impeller blades and is centered on the impeller axis by a support comprising radial arms attached to the fan guard. For noise reduction, the radial arms are supported on the hub of the impeller, on the side facing the fan shaft, by means of a roller bearing held by a mounting plate, and the mounting plate is made independent of the impeller bearing.

1 Claim, 2 Drawing Figures

AXIAL FAN

This application is a continuation application of application Ser. No. 288,809, filed July 31, 1981 now abandoned.

BACKGROUND OF THE INVENTION

The present invention relates to an axial fan, preferably for the cooling systems of water-cooled internal combustion engines, comprising an impeller and an air duct housing provided with a fan guard which is separated by an annular gap from the tips of the impeller blades and is centered on the impeller axis by a support comprising radial arms attached to the fan guard.

DESCRIPTION OF THE PRIOR ART

In known axial fans of the abovementioned type the fan guards are rigidly connected to the air duct housing and, subsequently, to the cooling radiator. Therefore, the annular gap between fan guard and tips of the impeller blades must be wide enough to accommodate both the assembly tolerances of combustion engine and radiator, e.g. in a vehicle, and the relative movements to be expected between combustion engine and vehicle or radiator, without any damage to the axial fan. Since the impeller gap, i.e. the annular gap between the tips of the impeller blades and the air duct housing, is a key parameter both with respect to the efficiency of the fan and to the fan noise generated, a large annular gap is a decided disadvantage.

In the course of the various attempts at maintaining the impeller gap as narrow as possible, axial fans have been designed having fan guards directly supported by the combustion engine, thus sharing the engine movement. As it is hardly possible, however, to provide the mounting points on the combustion engine and the fan guard supports with adequate tolerances, the fan guard, or rather the annular gap between impeller and fan guard must be carefully adjusted on installation of the fan. Because of the high cost involved in such fine adjustments the known types of design again are characterized by comparatively wide impeller gaps, i.e. between 10 and 20 mm.

Finally, axial fans of the aforementioned type are known, e.g. from U.S. Pat. No. 3,144,859, which do permit narrower impeller gaps but include other serious drawbacks. For example, the fan guard is centered on the impeller axis by radial brackets which are attached to the bearing flange of the fan shaft. If the axial fan were used e.g. in an internal combustion engine enclosed by a sound-insulating housing, this would mean for this known type of design that a sound-insulating barrier would need to be provided between the internal combustion engine and the bearings of the fanshaft, since otherwise structure-borne sound would be carried into the radial arms of the fan guard. If the fanshaft bearing is positioned within the sound-insulating housing, which is normally the case with an enclosed engine, this arrangement cannot be used at all, as it would necessitate an additional de-coupling—which would be quite complicated—and a sound-proof penetration of the radial arms through the wall of the housing.

SUMMARY OF THE INVENTION

It is an object of the present invention to improve upon axial fans of the aforementioned type such that the above noted disadvantages can be eliminated, enabling the impeller gap to be maintained small while permitting easy installation of the axial fan, and at the same time maintaining the fan noise low.

According to the present invention this is achieved by supporting the radial arms on the side facing the fan axis on the hub of the impeller by means of a roller bearing located in a mounting plate, and by making this plate completely independent of the main impeller bearing. The fan guard is supported by the fan itself, which will permit narrow tolerances for the support without any expense, and thus impeller gaps of some 2 to 5 mm, without any adjustment during installation. Narrowing the impeller gap will improve the acoustic characteristics of the fan and will be accompanied by the additional advantage of permitting a general reduction of fan dimensions due to the greater efficiency of the axial fan resulting from this step, without impairing the throughput; the lower peripheral velocity of the impeller resulting from this reduction will offer further advantages with regard to the reduction of fan noise. In addition, the design according to the present invention will ensure that the support of the fan guard centered on the fan axis is entirely independent of surrounding engine parts, and will thus avoid the risk of conveying structure-borne sound into the fan guard or the support in a simple and efficient manner. The roller bearing in the mounting plate permits precise centering of the fan guard relative to the impeller without any great expense and without any major friction losses.

The fan guard may be connected to the air duct housing by a flexible collar, e.g. made of rubber. This will serve to balance relative movements or tolerances between the fan guard moving together with the combustion engine and the rest of the duct housing, which is usually mounted on the radiator; at the same time the flexible collar will prevent the fan guard from turning with the impeller.

DESCRIPTION OF THE DRAWING

Following is a more detailed explanation of the present invention by means of exemplary embodiments as illustrated in the drawing, wherein.

DESCRIPTION OF THE PREFERRED EMBODIMENTS

Figure 1:
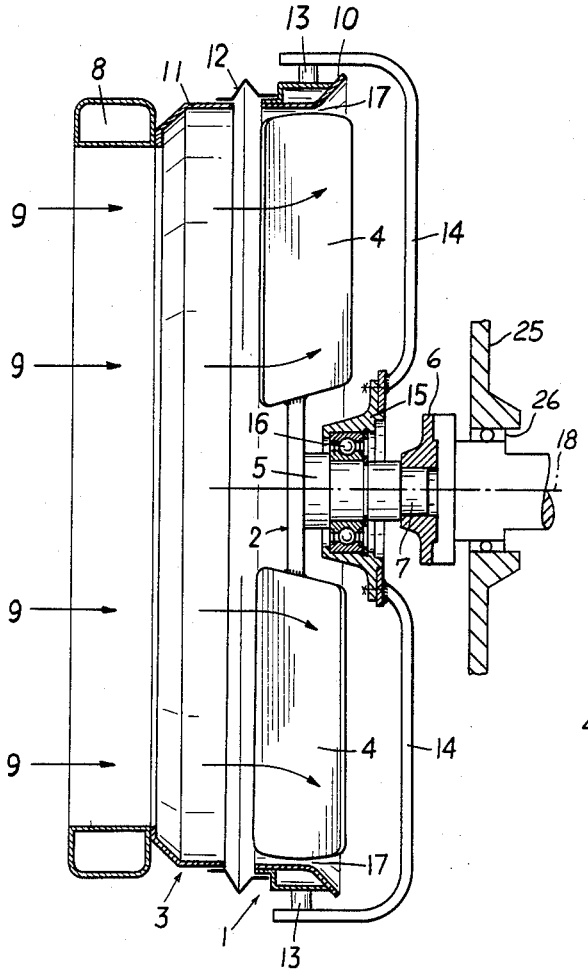
FIG. 1 is a vertical sectional view taken through an axial fan designed according to this invention.

The axial fan 1 shown in FIG. 1 essentially comprises an impeller 2 and an air duct housing 3. The impeller 2 has blades 4 and is attached via a hub 5 to a shaft 7, which is driven via a driving plate 6 by an internal combustion engine 25.

On the side facing away from the impeller 2 the air duct housing 3 is rigidly connected to a cooling radiator 8, through which cooling air is drawn in (in the direction indicated by arrows 9) during operation of the axial fan. On the side of the air duct housing 3 opposite of the cooling radiator 8 this housing terminates in a fan guard 10 which is fastened to the front part 11 of the air duct housing 3 by means of a flexible rubber collar 12.

The fan guard 10 is provided with lugs 13, by which it is attached to radial arms 14. On the side facing the fan shaft the radial arms 14 are supported on the hub 5 of the impeller 2 by means of a roller bearing 16 held by a mounting plate 15, which will ensure that the gap 17 between the tips of the impeller blades and the fan guard 10 is independent of the relative movements between the impeller and the fan guard, or rather between the internal combustion engine and the radiator. A portion of the engine is shown at 25 with a main bearing 26 supporting drive shaft 7, as in any normal manner.

Therefore, the gap 17 can be kept very small by centering the fan guard 10 on the axis 18 of the impeller 2 as shown, which will lower the noise of the axial fan in this area and will permit an overall reduction of the dimensions of the fan due to its higher efficiency, thus resulting in less noise on account of the reduced peripheral velocity of the impeller 2.

In the example illustrated, the fan guard 10 is prevented from turning with the impeller 2 by the elastic collar 12.

Figure 2:
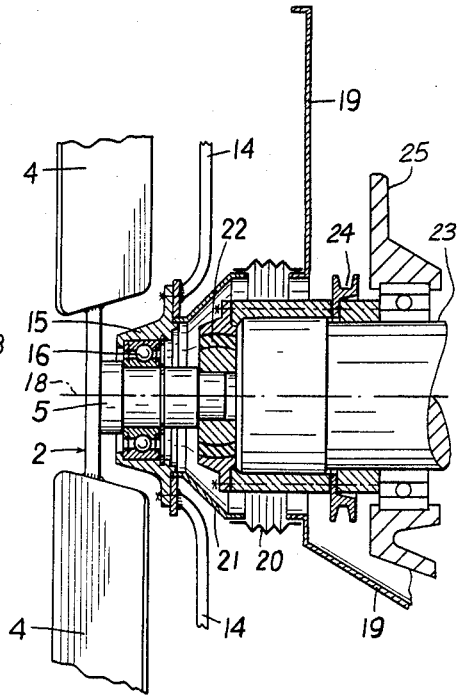
FIG. 2 is a partial sectional view similar to FIG. 1 of another variant of the present invention.

The variant of the invention shown in FIG. 2 is mainly concerned with the impeller 2 and its blades 4 and hub 5 on which the fan guard (not shown) is supported by way of the roller bearing 16 held by the mounting plate 15, and by radial arms 14. In this case, the internal combustion engine 25 is completely enclosed by a sound-insulating housing 19, with the axial fan itself located outwardly of this housing.

The opening for the driving shaft of the axial fan is sealed by a flexible collar 20, which is attached to both the housing 19 and to a part 21 sealing against the mounting plate 15.

The impeller 2 is driven via a vibration-insulating hub 22, which is located on the driving shaft 23 and is used for insulating the impeller against noise. The driving shaft 23 also is provided with a V-belt wheel 24 for driving accessory assemblies (not shown).

Again, the above example clearly shows the advantages of the arrangement according to the present invention which permits the gap between the fan guard and the tips of the impeller blades to be maintained at a minimum by centering the fan guard on the axis 18 of the impeller 2, without necessitating a complex sound-proof penetration of the sound-insulating housing for the support of the fan guard, as would be the case if the fan guard were supported by the internal combustion engine 25 itself.

I claim:

1. An air duct housing for an axial fan having impeller blades mounted on the drive shaft of a water-cooled internal combustion engine mounted on a support and having a cooling radiator, comprising an annular fan guard surrounding the tips of said blades and defining therewith a narrow annular gap in the range of 2 to 5 mm, a roller bearing on said shaft and lying outwardly of the engine, a mounting plate supported on said bearing independently of the engine support and independently of the engine, radial arms spaced from and unattached to the engine and interconnecting said fan guard with said mounting plate for centering said fan guard on the fan axis and for isolating any engine movement from said fan guard to thereby maintain said narrow annular gap, the housing further comprising an annular part rigidly connected to the engine radiator, means interconnecting said fan guard with said annular part for preventing rotation of said fan guard relative to said drive shaft, and a sound-insulated housing surrounding the engine with a portion of said sound-insulated housing lying within the space between said arms and the engine, whereby any noise sounds emanating from the engine are not transmitted outwardly of said sound-insulated housing via said radial arms.

* * * * *